US006755958B2

(12) United States Patent
Datta

(10) Patent No.: US 6,755,958 B2
(45) Date of Patent: Jun. 29, 2004

(54) BARRIER LAYER FOR ELECTRICAL CONNECTORS AND METHODS OF APPLYING THE LAYER

(75) Inventor: Amit Datta, East Greenwich, RI (US)

(73) Assignee: Handy & Harman, Rye, NY (US)

( * ) Notice: Subject to any disclaimer, the term of this patent is extended or adjusted under 35 U.S.C. 154(b) by 11 days.

(21) Appl. No.: 10/015,500

(22) Filed: Dec. 11, 2001

(65) Prior Publication Data

US 2003/0035977 A1 Feb. 20, 2003

Related U.S. Application Data

(60) Provisional application No. 60/254,751, filed on Dec. 11, 2000.

(51) Int. Cl.[7] ..... C23C 28/00; C23C 28/02; C25D 5/10; C25D 5/34

(52) U.S. Cl. ..... 205/191; 205/176; 205/183; 205/184; 205/210; 205/215

(58) Field of Search ..... 205/255, 176, 205/191, 183, 184, 210, 215

(56) References Cited

U.S. PATENT DOCUMENTS 5,695,810 A 12/1997 Dubin et al.

2002/0187364 A1 12/2002 Heber et al.

FOREIGN PATENT DOCUMENTS

| | | | |
|---|---|---|---|
| JP | 55146806 A | | 11/1980 |
| JP | 56-154261 A | * | 11/1981 |
| JP | 57057886 A | | 4/1982 |

OTHER PUBLICATIONS

Chow et al., "Interdiffusion of Cu Substrate/Electrodeposits for Cu/Co, Cu/Co–W, Cu/Co/Ni and Cu/Co–W/Ni Systems", Surface and Coatings Technology, vol . 99, Issues 1–2, Feb. 5, 1998, pp. 161–170.*

* cited by examiner

*Primary Examiner*—Edna Wong
(74) *Attorney, Agent, or Firm*—Law Office of Leo Zucker

(57) ABSTRACT

A cooper or copper alloy electrical contact member is treated by electroplating a barrier layer on a contact surface of the member, the barrier layer having a thickness ranging from about 0.00001 inch to about 0.0001 inch, and the barrier layer is selected from the group consisting of cobalt, cobalt-nickel alloys, cobalt-tungsten alloys, cobalt-nickel-tungsten alloys, and rhodium. An outer finish layer is coated over the barrier layer, and the finish layer is selected from the group consisting of tin, gold, palladium, platinum, silver, and alloys thereof, so that the electrical contact resistance of the treated contact member does not exceed about 10 milliohms at 100 grams contact force over a period of at least 1000 hours, and at a temperature of at least 150 degrees C.

10 Claims, 3 Drawing Sheets

BARRIER LAYER FOR ELECTRICAL CONNECTORS AND METHODS OF APPLYING THE LAYER

CROSS-REFERENCE TO RELATED APPLICATIONS

This application claims the benefit under 35 U.S.C. 119(e) of U.S. Provisional Application Ser. No. 60/254,751, filed Dec. 11, 2000.

BACKGROUND

1. Field of the Invention

This invention relates to electrical contacts that are treated to maintain minimal contact resistance.

2. Discussion of the Known Art

Electrical contacts are generally made from copper or copper alloys due to their relatively high electrical conductivity. Copper alloys oxidize easily, however, which reduces the integrity of their electrical contacts. Therefore, copper electrical contacts are usually coated with a layer of material that oxidizes less readily than copper. One example of such a material is tin, which is typically applied as a coating ranging in thickness from about 0.0001 to about 0.0003 inch. In addition to preventing the copper contacts from oxidizing and thereby maintaining the electrical integrity of the contacts, the tin coating also imparts solderability if needed for the application.

One problem associated with using tin coating is due to the relatively high rate of diffusibility of copper in tin ($0.8\times10^{-6}$ $cm^2$/sec @ 500K). Copper also forms solid solutions with tin, and may also form stable intermetallics such as $Cu_3Sn$ and $Cu_6Sn_5$, which severely degrade contact resistance, leading to failure of soldered joints or contacts.

To minimize or eliminate the interaction of the copper with the tin, an intermediate, or barrier layer is sometimes applied between the copper layer and the tin layer. Examples of such barrier layers include nickel, palladium-cobalt, and gold. Palladium-cobalt and gold barrier layers are effective but expensive and their use is generally limited to critical connectors for computer applications. Nickel layers are less expensive and are therefore used in high-volume price sensitive applications, such as automotive electronics applications. Ever increasing use of automotive electronics under the hood, which are generally exposed to temperatures of greater than about 100° C., have created the need for an alternate barrier layer with superior performance and reduced cost.

Attempts to provide alternative barrier layers include the electroplating of nickel over a nickel-phosphorus layer, as shown in FIG. 1; the use of cobalt-tungsten phosphide has also been reported as a barrier material; and use of a thicker tin layer has also been tried as a way to maintain the electrical integrity of the contacts.

However, thicker tin layers tend to gall, thereby increasing the contact insertion force. "Gall," or "galling" as used herein, means plastic deformation at the interface of two surfaces resulting from the two surfaces sliding against each other, retarding further movement. In electrical contact applications, soft tin coated connectors tend to gall when inserted in tin coated female adaptors, thereby increasing the insertion force.

SUMMARY

According to the invention, a method of treating an electrical contact member made of copper or a copper alloy includes electroplating a barrier layer on a contact surface of the member wherein the barrier layer is selected from the group consisting of cobalt, cobalt-nickel alloys, cobalt-tungsten alloys, and cobalt-nickel-tungsten alloys; forming the barrier layer to a thickness in the range of from about 0.00001 inch to about 0.0001 inch, and which thickness is sufficient to prevent the electrical contact resistance of the treated contact member from increasing above a given limit over a given period of time at a given temperature; and coating an outer finish layer over the barrier layer, wherein the finish layer is selected from the group consisting of tin, gold, palladium, platinum, silver, and alloys thereof, so that the given limit of electrical contact resistance of the treated contact member is about 10 milliohms at 100 grams contact force, the given period of time is at least 1000 hours, and the given temperature is at least 150 degrees C.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE INVENTION

Figure 3:
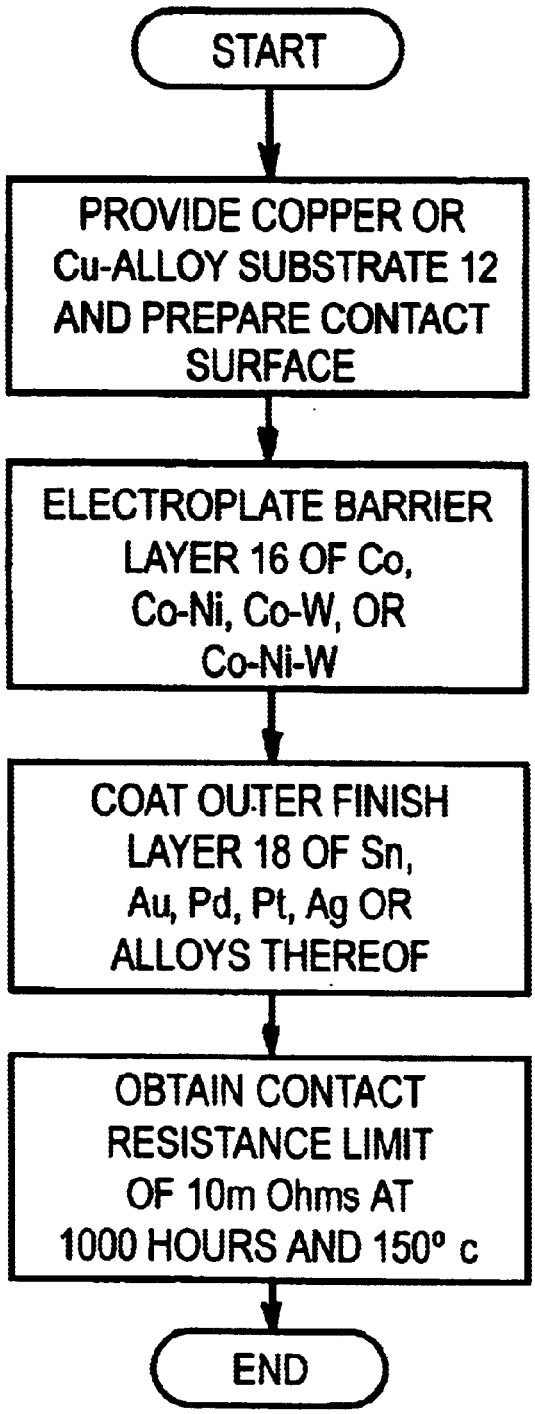
FIG. 3 is a flow diagram illustrating steps of the inventive method.

The present invention is directed to an improved barrier layer for electrical contacts, more specifically for electrical contacts formed of low resistance substrate materials such as copper or copper alloys. FIG. 3 illustrates steps for treating an electrical contact according to the invention.

The improved barrier layer maintains the integrity of the contact resistance over time. As such, the barrier layer of the present invention preserves the low contact resistance of the substrate material by minimizing interactions between the substrate material, the barrier layer and a finish coating which includes, but is not limited to, Sn and precious metals such as Au. The improved barrier layer of the present invention has a resistivity somewhat higher than the substrate material, relatively low diffusivity in the substrate material, relatively low solid solubility in the substrate material, and relatively high intrinsic electrical conductivity. In addition to maintaining the integrity of the electrical contact and preventing degradation of the contact resistance, the barrier layer also preferably has a low friction coefficient.

The barrier layer may be electroplated on the substrate at relatively high speed and with relatively high efficiency. The barrier layer is preferably composed of materials that are precious metal-free and, thus, relatively low cost. The barrier layer adheres well to tin or gold, is relatively hard, and is anti-galling for low insertion force. "Anti-galling," as used herein, means preventing or reducing plastic deformation at an interface between two surfaces when sliding against each other, retarding further movement. "Anti-galling," as used herein with reference to electrical contact applications, means reducing the insertion force of coated connectors when mated with soft tin coated female connectors.

Materials that have been found suitable for the barrier layer of the present invention include rhodium, cobalt and cobalt alloys such as cobalt-nickel, cobalt-tungsten, cobalt-nickel-tungsten and nickel-tungsten. Although copper also has a relatively low diffusivity in tungsten, tungsten cannot be electroplated as elemental tungsten. It can be plated as a tungsten alloy such as Co-W, Ni-W or Co-Ni-W, with a relatively high efficiency.

Figure 1:
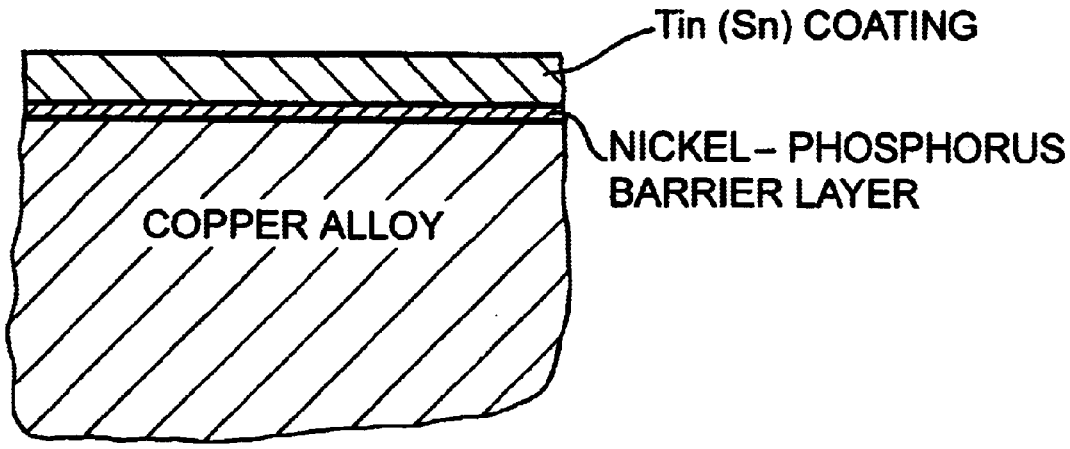
Prior Art FIG.1
FIG. 1 is a schematic illustration of a prior art metallization scheme.
Figure 2:
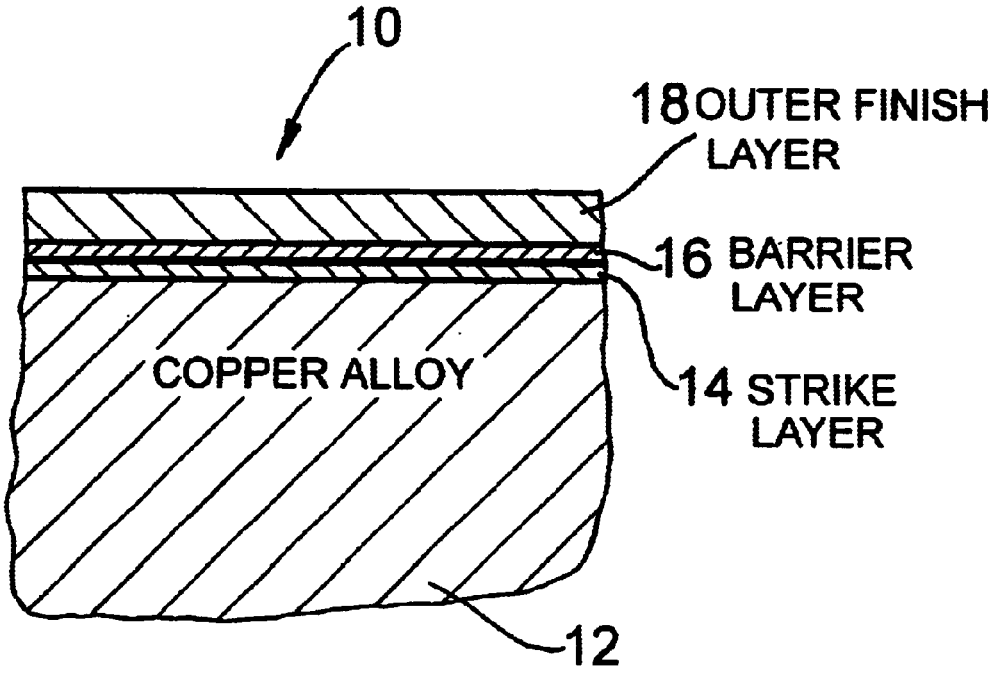
FIG. 2 is a schematic illustration of one embodiment of the inventive electrical contact with a nickel, cobalt, tungsten or rhodium barrier layer.

One embodiment of an electrical contact 10 is illustrated schematically in cross-section in FIG. 2. As shown in FIG. 2, electrical contact 10 includes a substrate 12, a strike layer 14, and a barrier layer 16. Although not always necessary, an outer coating or finish layer 18 is preferably included. Substrate 12 may be any low resistance material, preferably copper. As used herein, "copper" refers to copper and alloys of copper.

Electrical contact 10 has also preferably exhibits a contact resistance of less than about 10 milliohms, more preferably less than about 5 milliohms, and in a particularly preferred embodiment, less than about 2 milliohms.

Strike layer 14 may be formed from a metallic material including, but not limited to, gold, silver, platinum, palladium, and combinations thereof. The purpose of strike layers, which are generally known in the art, is to among other things to provide a suitable surface on which to apply a successive layer, which is in the present embodiment is the barrier layer 16. Strike layer 14 is preferably very thin, particularly having a thickness ranging from about 5 microinch to about 20 microinch, more particularly about 10 microinch.

Barrier layer 16 is preferably composed of cobalt or an alloy of tungsten such as nickel-cobalt-tungsten. The barrier layer 16 may have a thickness ranging from about 0.00001 inch to about 0.0001 inch, more particularly about 0.00005 inch.

The electrical contact 10 preferably has an outer layer or finish coating 18. In one embodiment, outer layer 18 is composed of a material having a relatively low tendency oxidation and is usually solderable. For example, suitable materials for outer layer 18 include, but are not limited to, tin or precious metals such as gold, silver, platinum, palladium and alloys thereof.

The substrate 12 is preferably subjected to a first surface treatment to remove any surface oxidation and, if desired, a second surface treatment to activate the surface in preparation for electroplating the barrier layer. A mentioned, such surface activation may be, for example, depositing the strike layer, which may include, for example, nickel or silver.

After the surface treatment(s) is applied, the substrate 12 is immersed in an electroplating bath in order to deposit the barrier layer 16 directly on the substrate 12 or on the strike layer 14. After depositing the barrier layer, the outer layer 18 is deposited, for example by electroplating, although other methods known to those of skill in the art may be used, including evaporation, sputtering, and resistance evaporation. For example, tin may be deposited as the outer layer 18.

Suitable plating baths for the barrier layer 16 include cobalt sulphamate solutions, sodium tungstate solutions, cobalt and nickel sulphamate and sodium tungstate solutions, and cobalt sulphate nickel sulphate and sodium tungstate solutions. The electroplating baths may additionally include additives, brighteners, anti-pitting additives, and the like. If desired or necessary, the pH of the electroplating bath may be adjusted and/or buffered as known to those of skill in the art.

The present invention will be further illustrated by the following examples, which are intended to be illustrative in nature and are not to be considered as limiting the scope of the invention.

WORKING EXAMPLES 1 AND 2

Metal contacts using a variety of different barrier layers were formed in order to evaluate their contact resistivity. The barrier layers were electroplated at relatively high speed and relatively high efficiency. "High speed," as used herein, means about 25 microinch/minute. "High efficiency," as used herein, means greater than about 50% efficiency. Each barrier layer was applied to a copper substrate. The surface of each copper substrate was treated by lightly etching the substrate in a standard acid bath for about 20 seconds to remove any surface oxide layers and to "activate" the surface. In some instances, the effects of surface activation were also examined using a 2 minute nickel strike (Wood's) or a 20 second standard silver strike (silver cyanide).

Current densities were varied to get a bright deposit. Current densities, pH, and temperature were adjusted to achieve a bright finish. Plating times were selected according to metal concentrations and current densities to achieve a coating thickness of less than or equal to about 0.0002 inch, more preferably about 0.0001 inch.

Samples were examined in the as-received, as-aged, as tin-plated and as tin-plated and aged condition. Aging was performed for 240 hours at 150° C.

Samples were tested to determine the contact resistance at various loads in the as-received, as tin-plated and aged condition (3000 hours at 125° C.). Contact resistance values greater than about 10 milliohms were considered failures. The codes listed in Table 1 below were used to represent the contact resistance values of the samples.

TABLE 1

| CONTACT RESISTANCE | CODE |
|---|---|
| greater than about 10 milliohms | Fail (F) |
| about 5 to about 10 milliohms | Good (G) |
| about 2 to about 5 milliohms | Very Good (VG) |
| less than about 2 milliohms | Excellent (E) |

EXAMPLE 1

COBALT

A layer of cobalt was electroplated on a copper substrate for evaluation as a barrier layer. The cobalt was deposited using a bath containing cobalt sulphamate, and citric acid. The pH of the plating bath was adjusted to a range of about 3–5 using cobalt carbonate.

TABLE 2

| | Sample | | | |
|---|---|---|---|---|
| | I | II | III | IV |
| Acid Etch | yes | yes | yes | yes |
| Strike | no | nickel | no | silver |
| Anode | Nickel or Cobalt | Nickel or Cobalt | Nickel or Cobalt | Nickel or Cobalt |

TABLE 2-continued

| | Sample | | | |
|---|---|---|---|---|
| | I | II | III | IV |
| Cathode | | | | |
| Plating Bath Composition | cobalt sulphamate | cobalt sulphamate | cobalt sulphamate | cobalt sulphamate |
| Plating Bath Additives | none | none | none | none |
| Plating Bath Temperature (° F.) | 140 | 140 | 140 | 140 |
| Current Density (ASF) | 40 | 40 | 40 | 40 |
| Time (minutes) | 2–3 | 2–3 | 2–3 | 2–3 |
| pH range | 3–5 | 3–5 | 3–5 | 3–5 |
| pH adjustment | cobalt carbonate | cobalt carbonate | cobalt carbonate | cobalt carbonate |
| Plating Deposit | cobalt | cobalt | cobalt | cobalt |

TABLE 3

| SAMPLE | AS-RECEIVED | AS TIN-PLATED | AS-AGED | AS TIN-PLATED AND AGED |
|---|---|---|---|---|
| I | E | — | E | — |
| II | G | — | F | — |
| III | — | G | — | G |
| IV | — | G | — | VG |

As shown in Table 3, cobalt sulphamate without any additives produces an excellent barrier coating and may not require any tin coating (or an extremely thin tin coating). A light etch without any subsequent nickel strike produces an acceptable surface activation of copper alloys. Moreover, the resulting contact resistance is superior to surface treatment that includes a light etch and nickel strike. However, surface treatment that includes a light etch followed by a silver strike produces a superior contact resistance value.

EXAMPLE 2

NICKEL-TUNGSTEN

A layer of nickel-tungsten was electroplated on a copper substrate for evaluation as a barrier layer. The nickel-tungsten coating (65% Ni, 35% W) was deposited using a bath (Enthone Ni-500) containing nickel sulphate, sodium tungstate, and citric acid. Enthone Ni-500 plating bath contains a nickel salt (such as nickel sulphate), a tungsten salt (sodium tungstate), and an organic acid (citric acid).

The pH of the plating bath was adjusted to a range of about 7–9 using ammonium hydroxide.

TABLE 4

| | Example | | |
|---|---|---|---|
| | V | VI | VII |
| Acid Etch | yes | yes | yes |
| Strike | no | nickel | silver |
| Anode | inert or soluble W | inert or soluble W | inert or soluble W |
| Cathode | | | |
| Plating Bath Additives | | | |
| Nominal Plating Bath Temperature (° F.) | 140 | 140 | 140 |

TABLE 4-continued

| | Example | | |
|---|---|---|---|
| | V | VI | VII |
| Current Density (ASF) | 20–50 | 20–50 | 20–50 |
| Time (minutes) | 5 | 5 | 5 |
| pH range | 7–9 | 7–9 | 7–9 |
| pH adjustment | ammonia | ammonia | ammonia |
| Plating Deposit | nickel tungsten | nickel tungsten | nickel tungsten |

TABLE 5

| SAMPLE | AS-RECEIVED | AS TIN-PLATED | AS-AGED | AS TIN-PLATED AND AGED |
|---|---|---|---|---|
| V | E | G | F | VG |
| VI | F | — | F | — |
| VII | E | VG–E | F | VG–E |

As shown in Table 5 above, a nickel-tungsten alloy coating electroplated from an alkaline bath containing a nickel salt (such as nickel sulphate), a tungsten salt (sodium tungstate), an organic acid (citric acid) and ammonium hydroxide can produce an excellent barrier coating. A light acid etch is an acceptable surface treatment. Contact resistance values can be improved with a silver strike following the light etch. The Ni—W coating requires, however, a tin outer layer to retain its excellent contact resistance values.

PROSPECTIVE EXAMPLES 3 AND 4

PROSPECTIVE EXAMPLE 3

COBALT-TUNGSTEN

A layer of cobalt-tungsten is electroplated on a copper substrate for evaluation as a barrier layer. The cobalt-tungsten coating is deposited using a bath containing cobalt sulphamate, sodium tungstate, and citric acid. The pH of the plating bath is adjusted to a range of about 7–9 using ammonium hydroxide.

TABLE 6

| Example | VIII |
|---|---|
| Acid Etch | |
| Strike | |
| Anode | inert (stainless steel) or Co—W |
| Cathode | |
| Plating Bath Composition | cobalt sulphamate, sodium tungstate, citric acid |
| Plating Bath Additives | |
| Plating Bath Temperature (° F.) | 140 |
| Current Density (ASF) | 20–30 |
| Time (minutes) | 5 |
| pH range | 7–9 |
| pH adjustment | ammonium hydroxide |
| Plating Deposit | cobalt-tungsten |

PROSPECTIVE EXAMPLE 4

COBALT-NICKEL-TUNGSTEN

A layer of cobalt-nickel-tungsten is electroplated on a copper substrate for evaluation as a barrier layer. The cobalt-nickel-tungsten coating is deposited using a bath containing cobalt and nickel sulphamate, sodium tungstate and citric acid. The pH of the plating bath is adjusted to a range of about 7–9 using ammonium hydroxide.

TABLE 7

| Example | IX |
|---|---|
| Acid Etch | |
| Strike | |
| Anode | inert or soluble W |
| Cathode | |
| Plating Bath Composition | cobalt and nickel sulphamate, sodium tungstate and citric acid |
| Plating Bath Additives | |
| Plating Bath Temperature (° F.) | |
| Current Density (ASF) | 20–40 |
| Time (minutes) | 5 |
| pH range | 7–9 |
| pH adjustment | Ammonia |
| Plating Deposit | cobalt-nickel-tungsten |

All the coatings are expected to have low galling characteristics and, hence, low insertion force compared to only tin coated contacts.

WORKING EXAMPLES 5A–5C

COMPARISON OF COBALT AND NICKEL

Examples 5A through 5C compares the contact resistance characteristics of one embodiment of the present invention utilizing cobalt as the material for the barrier coating to a nickel material as a standard nickel barrier coating.

For examples 5A–5C, the Ni barrier coating was plated from a nickel sulphamate bath with a pH of 3–3.5 at a current density of about 150 amps/ft$^2$ ("ASF").

For examples 5A–5C, the cobalt barrier coating was plated from a cobalt sulphamate bath with a pH of 3.5, a concentration of about 100 grams of cobalt/1 liter of solution, a temperature of about 140F. and at about the same current density. Although these specific conditions were utilized for these examples, other suitable conditions that may have been utilized for these examples include: other solutions of cobalt salt; concentration ranges from about 50 to about 200 grams of cobalt/1 liter of solution; temperature ranges of about 80F. to about 200F.; additives such as wetting agents; and a ph range of about 2.5 to about 5. The pH may be adjusted to improve the ductility properties of the cobalt.

For example 58, following the application of the barrier coating, the samples were finish coated with a 5 micro-inch layer of gold. For example 5C, following the application of the barrier coating, the samples were finish coated with a 40–50 micro-inch layer of Sn-Pb alloy. All coating thickness values were measured using an XRF technique.

For examples 5A–5C, the effectiveness of the barrier layer 16 was evaluated by measuring the change in contact resistance values when exposed to normal application temperatures over time. The contact resistance test method utilized was ASTM B 667-92 ("Standard Practice for Construction and Use of a Probe for Measuring Electrical Contact Resistance"). In order to simulate this "aging" process, accelerated aging conditions were employed—samples were aged in air at 150 degrees C. and 250 degrees C. for various times and the contact resistance values were measured at 100 gms.

The change in contact resistance is caused by a number of interactions including: diffusion of the Cu substrate through the barrier layer 16 and its subsequent oxidation; formation of intermetallic compounds, particularly Cu-Sn intermetallics for the case of Sn or Sn-Pb finish coatings 18; interdiffusion of the barrier layer 16 and the finish coatings thus forming solid solutions or intermetallic compounds and oxidation of the barrier layer 16. A more effective barrier layer is one that retards the mentioned interactions. Thus, a more effective barrier shows a smaller change in contact resistance values when exposed to normal application temperatures over time—the simulated aging process.

WORKING EXAMPLE 5A

Copper alloy strips were coated with 15–20 micro-inch thick Ni or Co barrier layers and samples were aged in air at 150 degrees C. for various times as shown in Table 8 below. Table 8 shows that barrier layers made of cobalt were more effective than the Ni barrier layers as the contact resistance for the cobalt barrier layers changed at a slower rate than for the Ni barrier coating layers.

TABLE 8

| Aging time at 150 degrees C., Hrs. | 100 gm contact resistance, Ni barrier | 100 gm contact resistance, Co barrier |
|---|---|---|
| 0 (as-received) | 3.8 m.ohms | 2.67 m.ohms |
| 168 | 12.8 m.ohms | 5.43 m.ohms |
| 504 | 72.4 m.ohms | 17.4 m.ohms |
| 1008 | 92.0 m.ohms | 28 m.ohms |

WORKING EXAMPLE 5B

Following the application of 15–20 micro-inch of Ni or Co barrier layers, the copper alloy samples were finish coated with a 5 micro-inch layer of Au. The samples were aged in air at 150 degrees C. for different times and their contact resistance values were measured as a function of aging time as shown in Table 9. Table 9 again shows that barrier layers containing cobalt are more effective than the Ni barrier layers with respect to rate of change of contact resistance.

TABLE 9

| Aging time at 150 degrees C., Hrs. | 100 gm contact resistance, Ni barrier + Au finish | 100 gm contact resistance, Co barrier + Au finish |
|---|---|---|
| 0 (as-received) | 1.89 m.ohms | 0.68 m.ohms |
| 168 | 1.71 m.ohms | 0.68 m.ohms |
| 504 | 3.49 m.ohms | 1.76 m.ohms |
| 1008 | 5.06 m.ohms | 1.25 m.ohms |

WORKING EXAMPLE 5C

Following the application of Ni and Co barrier layer 5–20 micro inch thick, copper alloy strips were coated with a 40–50 micro-inch thick Sn-Pb alloy finish coating 18. The samples were aged in air at 250 degrees C. and their 100 gm contact resistance values were measured as a function of aging time as illustrated in Table 10. Table 10 again shows that barrier layers containing cobalt were more effective than the Ni barrier its layers over time with respect to contact resistance.

TABLE 10

| Aging time at 250 degrees C., Hrs. | 100 gm contact resistance, Ni barrier + Sn—Pb finish | 100 gm contact resistance, Co barrier + Sn—Pb finish |
|---|---|---|
| 0 (as-received) | 0.654 m.ohms | 0.98 m.ohms |
| 168 | 5.15 m.ohms | 2.28 m.ohms |
| 504 | 26.2 m.ohms | 1.78 m.ohms |
| 1008 | | 2.36 m.ohms |

WORKING EXAMPLE 6

COBALT ALLOY

A Co/Ni alloy was plated on copper strips by using a bath of 70% nickel sulphamate and 30% cobalt sulphamate. The pH of the bath was about 3.5 and the coating was electroplated at about 50 ASF. The samples were evaluated for friction coefficient, as the "insertion force" which is dependent on friction coefficient is also another criterion for barrier coating optimization. Friction tests were conducted using the following conditions: 10 cycle sliding test; normal load 67 gms; bright Tin "dimple" coupon; coated sample fastened to the sliding base; and three samples per coating.

The coatings were compared against bright Tin, 70Ni30Co, and Co. A lower friction coefficient should result in a lower insertion force for connector applications. A comparison of the friction coefficients of the three samples are shown in Table 11 below.

TABLE 11

| Coating Combination | Mean Friction Coefficient |
|---|---|
| Sn/Sn | .59 |
| 70Ni30Co/Sn | .29 |
| Co/Sn | .39 |

As shown in Table 11, a cobalt-nickel alloy had a lower friction coefficient Consequently, the above results show that, with an appropriate finish, the present invention can yield both a low friction and contact resistance.

Although particular embodiments of the invention have been described in detail for purposes of illustration, various changes and modifications may be made without departing from the scope and spirit of the invention. All combinations and permutations of the electrical contacts and operational methods are available for practice in various applications as the need arises. Any substrate material other than copper may be used. Accordingly, the invention is not to be limited except as by the appended claims.

What is claimed is:

1. A method of treating a copper electrical contact member to enhance performance of the member over time with respect to its electrical contact resistance, comprising:

providing an electrical contact member made of copper or a copper alloy, the member having a contact surface;

electroplating a barrier layer on the contact surface, wherein the barrier layer is selected from the group consisting of cobalt, cobalt-nickel alloys, cobalt-tungsten alloys, and cobalt-nickel-tungsten alloys;

forming the barrier layer to a thickness in the range of from about 0.00001 inch to about 0.0001 inch, and which thickness is sufficient to prevent the electrical contact resistance of the treated contact member from increasing above a given limit over a given period of time at a given temperature; and coating an outer finish layer over the barrier layer, wherein the finish layer is selected from the group consisting of tin, gold, palladium, platinum, silver, and alloys thereof, so that the given limit of electrical contact resistance of the treated contact member is about 10 milliohms at 100 grams contact force, the given period of time is at least 1000 hours, and the given temperature is at least 150 degrees C.

2. The method of claim 1, including etching the contact surface with a light acid before the electroplating step.

3. The method of claim 2, including activating the contact surface before the electroplating step.

4. The method of claim 1, wherein the barrier layer is electroplated by adjusting a plating current density in the range of from about 10 to about 150 amperes per square foot.

5. The method of claim 1, wherein the electroplating step includes preparing a plating bath solution having at least one of cobalt sulphamate, cobalt sulfate, or cobalt chloride.

6. The method of claim 5, including preparing the plating bath solution with a tungsten salt, an organic acid, or ammonium oxide.

7. The method of claim 6, wherein the tungsten salt is sodium tungstate.

8. The method of claim 6, wherein the organic acid is citric acid.

9. The method of claim 1, including applying a strike layer on said contact surface before electroplating the barrier layer.

10. The method of claim 9, wherein the strike layer is selected from the group consisting of nickel and silver.

* * * * *